United States Patent [19]

Derasp

[11] 4,001,573

[45] Jan. 4, 1977

[54] LIGHTING POLE

[76] Inventor: Roger Derasp, 1825 Buies, Longueuil, Quebec, Canada

[22] Filed: Mar. 17, 1975

[21] Appl. No.: 559,304

[52] U.S. Cl. ..... 240/64; 240/67; 248/320

[51] Int. Cl.[2] ..... F21V 21/38

[58] Field of Search ..... 240/84, 63, 64, 65, 240/66, 67, 68, 69, 88; 248/328, 329, 330, 331, 332, 322, 320, 321

[56] References Cited

UNITED STATES PATENTS

| | | | |
|---|---|---|---|
| 277,168 | 5/1883 | Shedlock | 240/65 X |
| 663,420 | 12/1900 | Culter | 240/66 |
| 935,136 | 9/1909 | Wundelich | 240/66 |
| 1,157,239 | 10/1915 | McWilliams | 240/66 |
| 1,454,855 | 5/1923 | Larkins | 240/64 |
| 1,712,768 | 5/1929 | Johnston | 240/66 |
| 3,670,159 | 6/1972 | Millerbrand | 240/65 |
| 3,686,498 | 8/1972 | Meyer | 240/84 |
| 3,801,813 | 4/1974 | Kiehn | 240/84 X |
| 3,805,054 | 4/1974 | Wolf | 240/84 X |
| 3,862,744 | 1/1975 | Boemer | 240/64 |

*Primary Examiner*—L. T. Hix
*Assistant Examiner*—E. M. O'Connor
*Attorney, Agent, or Firm*—Bacon & Thomas

[57] ABSTRACT

A light pole having a support at the top of the pole and a light-carrying structure encircling the pole. A first fixed suspension is provided depending downwardly from the support and a second fixed suspension is provided on the light-carrying structure. The first and second fixed suspensions cooperate to detachably suspend the light-carrying structure from the support at a first position just beneath the support. A cable system extends from the support to the light-carrying structure for use in lowering the light-carrying structure down the pole for servicing the lights and for raising it back to the first position. The cable system is offset circumferentially with respect to the first suspension in order to impart a slight rotation of the light-carrying structure during the engagement and disengagement of the first and second suspensions. This rotation provides an easy and secure engagement and disengagement of the first and second suspensions with each other. The pole is provided at its bottom end with facilities for detachably receiving, within and without the pole, a control system for the cable system to raise and lower the light-carrying structure.

10 Claims, 11 Drawing Figures

Fig. 3
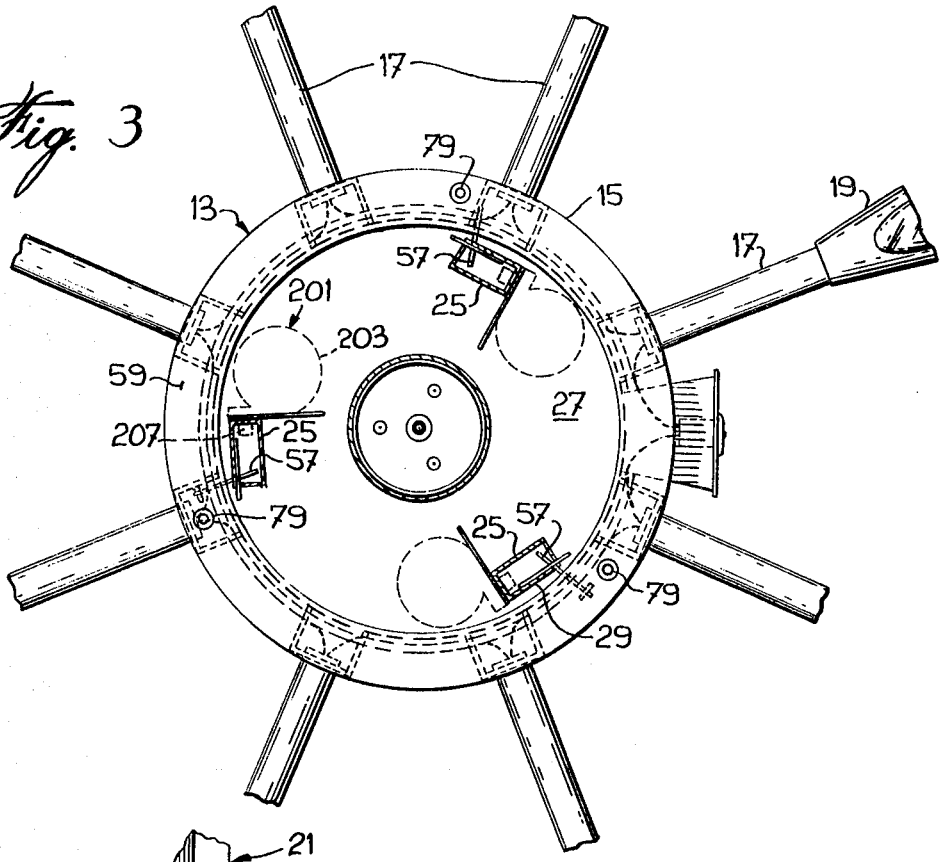
Fig. 7
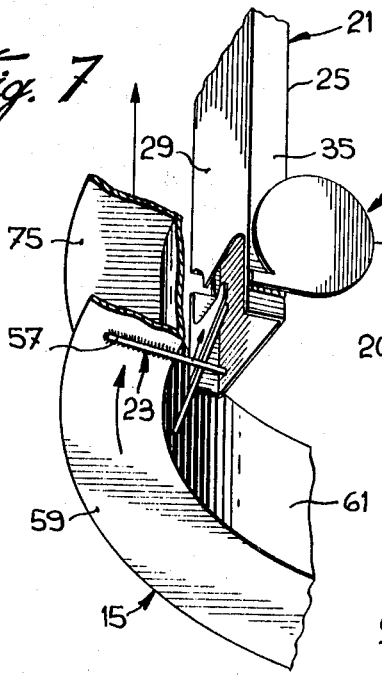
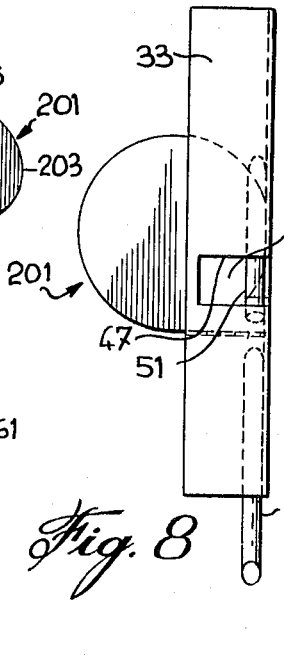
Fig. 8
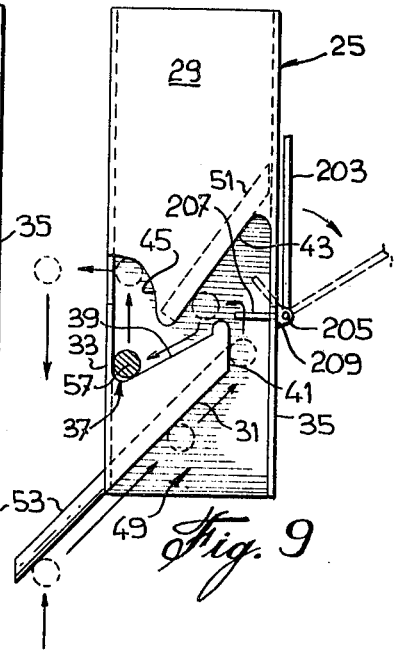
Fig. 9

LIGHTING POLE

This invention is directed toward improvements in lighting structures, and more particularly toward improvements in pole or tower lights.

Pole or tower lights are now usually made very tall and have a cluster of lights at the top. This construction provides more efficient lighting as compared to using many more shorter poles with only one or a few lights at the top. However, the taller poles make it more difficult to service the lights that they carry. To make servicing easier, the cluster of lights on the tall poles are mounted on a structure which can be lowered by cables running up the inside of the pole so that the lights can be serviced at ground level. Such a construction is shown, by way of example, in U.S. Pat. Nos. 3,670,159, issued June 13, 1972, P. A. Millerbernd inventor; and 3,686,498, issued Aug. 22, 1972, R. E. Meyer inventor.

However, this type of construction, employing a light carrying structure which can be lowered on the pole by cables, presents problems. Means must be provided to fixedly suspend the light-carrying structure from the top of the pole between servicing operations. Preferably, the weight of the light-carrying structure, when suspended at the top of the pole, should not be carried by the lowering cables to prevent stretching of the cables and/or wear of the cables. The suspending structure employed however is usually quite complicated and thus expensive. In addition, the suspending structure usually employs moving parts. The use of moving suspending parts increases the chance of malfunctioning of the suspending means and also, the use of moving parts at the top of the pole, means that they must be occasionally serviced thus negating, in part, the reason for using a lowerable, light-carrying structure.

The use of a lowerable, light-carrying structure on a light pole or tower also requires means at the bottom of the pole to operate the lowering cables attached to the structure. These operating means usually include a winch. In many cases a winch is permanently mounted in the bottom of each pole thus increasing the cost of each light unit.

It is therefore, a purpose of the present invention, to provide a lowerable, light-carrying structure for light poles or towers, and means for lowering the structure, which are very simple and inexpensive in construction and use. More particularly, the present invention is directed toward a light-carrying structure for light poles which is suspended from the top of the pole by simple, fixed means thus reducing construction and maintenance costs. The invention is also directed toward simple, portable, relatively inexpensive means for use in lowering the light-carrying structure.

The invention is particularly directed toward a lighting structure comprising a pole with support means at the top of the pole and a light-carrying structure encircling the pole. First fixed suspension means are provided depending down from the support means and second fixed suspension means are provided on the light-carrying structure. The first and second fixed suspension means cooperate to detachably suspend the light-carrying structure from the support means at a first position just beneath the support means. Cable means extend from the support means to the light-carrying structure for use in lowering the light-carrying structure down the pole for servicing and for raising it back to the first position.

The cable means are offset circumferentially with respect to the first suspension means in order to provide a slight rotation of the light-carrying structure during the engagement and disengagement of the first and second suspension means, this rotation providing an easy and secure engagement and disengagement of the first and second suspension means with each other.

Preferably, mounting means are provided at the bottom end of the pole for detachably receiving, both within and without the pole, means for operating the cable means for lowering the light-carrying structure for servicing, and then raising it back.

In a preferred embodiment, the first fixed suspension means comprises at least three members about the pole depending vertically down from the support means, and the second fixed suspension means comprises one projecting member for each depending member, and a notch in each depending member, defining the first position, for receiving a corresponding projecting member. Each depending member has means for guiding its corresponding projecting member up and into the notch as the light-carrying structure is raised to its first position. Each depending member has also means for guiding its corresponding projecting member up and out of the notch when the light-carrying structure is to be serviced.

Preferably, the cable means include at least three support cables extending to the light-carrying structure from the support means, each cable being associated with each depending member and being slightly offset circumferentially, on the support means, from its associated vertical depending member, each cable being vertically aligned with its associated projecting member on the light-carrying structure.

The operating means preferably comprise a winch detachably mounted without the pole and a pulley detachably mounted within the pole.

The invention will now be described in detail having reference to the accompanying drawings in which:

FIG. 3 is a detail bottom plan view, in partial section, of the top portion of the lighting structure;

FIG. 7 is a schematic view showing operation of the suspension means;

FIG. 8 is a side elevation view of a portion of the suspension means;

FIG. 9 is a front elevation view of the suspension means;

Figure 1:
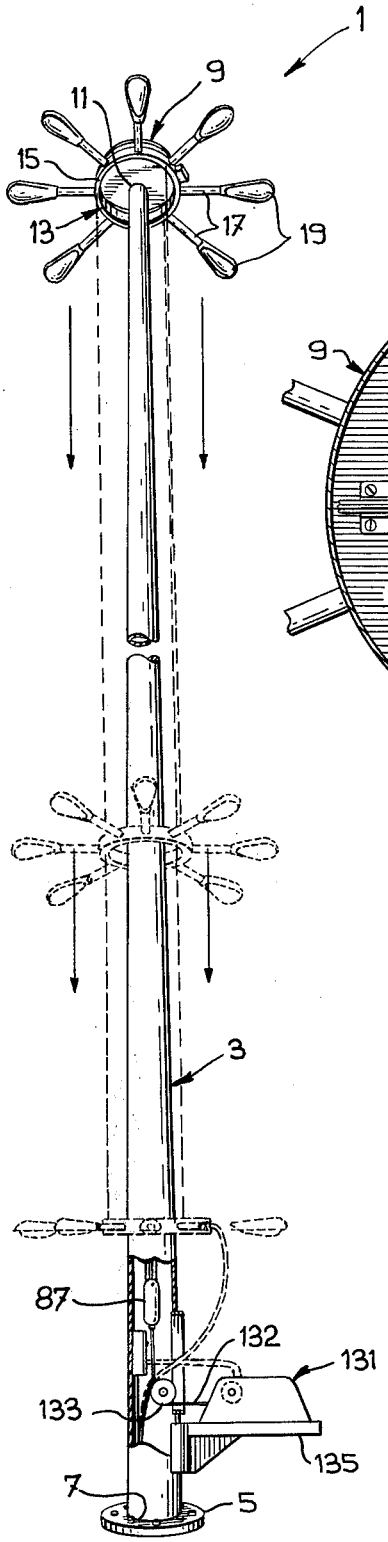
FIG. 1 is an elevation view of the lighting structure according to the present invention.
Figure 4:
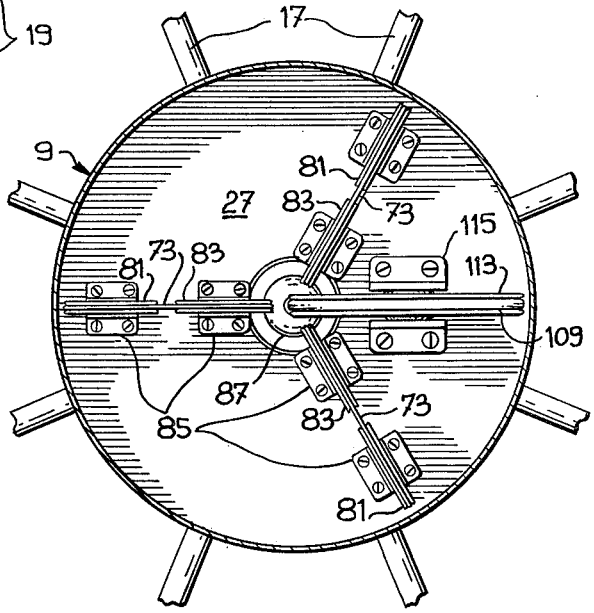
FIG. 4 is a plan view of the support means on the top of the pole with the cover removed.

As shown in FIG. 1, the lighting structure 1 of the present invention comprises a tapering tubular pole 3, having a base flange 5 at its bottom end 7 for mounting the pole vertically, and support means 9 at its top end 11.

Light-carrying structure 13 encircles the pole 3 and comprises a tubular ring 15 encircling the pole, in a plane substantially perpendicular to the pole, with arms 17 extending radially out from the ring 15. The arms 17 are equally spaced apart and have a light 19 at the end of each arm. Eight arms 17 and lights 19 are shown in the drawings, but more or less can be employed. The ring 15 has substantially the same diameter as the support means 9.

Figure 2:
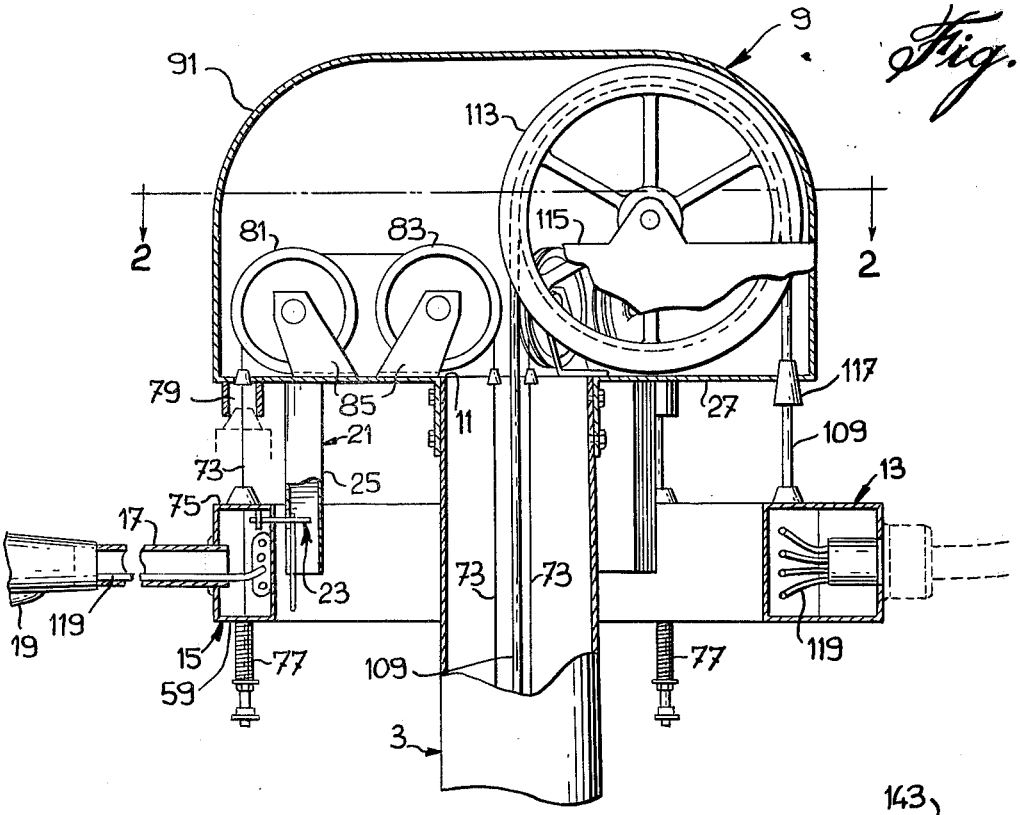
FIG. 2 is a detail elevation view, in partial cross-section, showing the top portion of the lighting structure.

The light-carrying structure 13 is normally suspended just beneath the bottom of the support means 9. To this end, first fixed suspension means 21 are provided on the support means 9 as shown in FIG. 2, and second fixed suspension means 23 are provided on the light-carrying structure 13. The first fixed suspension means 21 preferably comprises three equally spaced tubular members 25 attached to bottom wall 27 by welding or other suitable means and located on an imaginary circle about pole 3. Each member 25 preferably has a rectangular cross-section and the bottom portion of its outwardly facing wall 29 is shaped to provide cam and notch surfaces. More specifically, as shown in FIGS. 7, 8 and 9, a portion of the wall 29 is cut away to provide first a cam edge 31 which extends up and away from the bottom of one side wall 33 toward the opposite side wall 35. A notch 37 is provided above cam edge 31 formed by a portion of one side wall 33 and downwardly sloping notch edge 39. A first vertical guide edge 41, spaced slightly from side wall 35, connects cam edge 1 and notch edge 39. A second sloping guide edge 43, traverses vertical guide edge 41, spaced above it and sloping from side wall 35 down toward notch 37. Guide edge 43 terminates before notch 37 however. A third guide edge 45 extends up and curves outward to side wall 33. A slot 47 is provided in side wall 33 at the top of guide edge 45. The edges 31, 39, 41, 43, 45 and side walls 33, 35 form a serpentine slot 49. Edge 43 can be reinforced with a section rod 51 attached along it. Edge 31 can also be reinforced with a section of rod 53 attached along it. Rod 53 projects a distance down and away from member 25 for reasons to be described.

The second fixed suspension means 23 preferably comprises three equally spaced rods 57 attached to the bottom wall 59 of ring 15 and projecting radially inwardly therefrom past the inner wall 61 of ring 15 a distance sufficient to enter slot 49 in member 25 as will be described.

Light-carrying structure 13 is normally suspended just beneath, and from, support means 9, by having each of its rods 57 located in a notch 37 as shown in FIG. 9.

Figure 5:
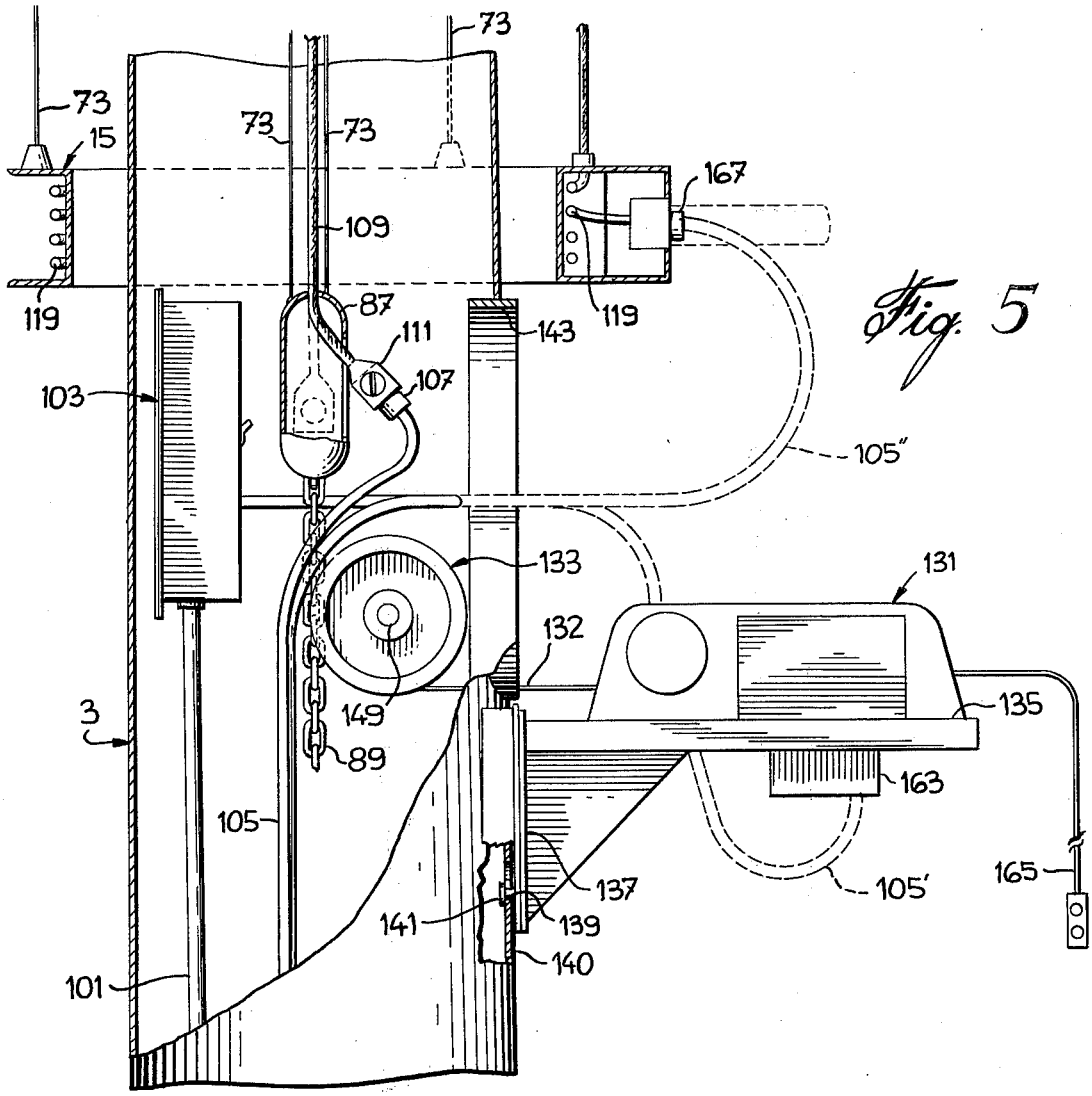
FIG. 5 is a detail elevation view, in partial section, of the bottom portion of the lighting structure, in which a first type of operating means is mounted.

Means are provided for use in lowering the light-carrying structure 13 down the pole so as to be able to service the lights 19 as will be described. The lowering means comprise three cables 73 each having one end attached to ring 15 of structure 13 as shown in FIG. 2. Each cable 73 passes vertically through top wall 75 of ring 15 and bottom wall 59. The bottom end of each cable 73 is attached to spring means 77. Each cable presses up through an opening 79 in bottom wall 27 of support means 9, near its outer edge, then in a radial direction, toward pole 3, over a pair of pulleys 81, 83 mounted by brackets 85 on wall 27, and down through the interior of pole 3. The cables 73 are attached to one end of a case 87 at the bottom of the pole as shown in FIG. 5. A chain 89 is detachable connected by suitable means (not shown) to the bottom end of case 87 and serves as a safety device to hold case 87, and thus cables 73 and structure 13 in the raised position. The bottom end of chain 89 is fixed to suitable anchoring means (not shown). A cover 91 protects the pulleys 81, 83.

Electrical power is supplied to lights 19 from a first power cable 101 entering pole 3 from its bottom end 7. Power cable 101 leads to a switch box 103 in the lower end of pole 3. A second power cable 105 leads from box 103 and has a plug 107 at its free end. The power cable 105 via plus 107, connects to a third power cable 109 having a connector 111, receiving plug 107, within case 87. Power cable 109 leads out from the top of case 87, up through pole 3 onto support means 9, around a guide pulley 113 mounted in support means 9 by a bracket 115, through a guide member 117 in bottom wall 27 of support means 9 and is finally connected to ring 15 of light support structure 13. Leads 119, within ring 15 and arms 17, connect power cable 109 to lights 19.

Detachable, portable means are provided for lowering the light-carrying structure 13 to service the lights 19.

According to a preferred embodiment, these lowering means comprise a winch 131, having a cable 132, and a pulley 133, as shown in FIG. 5. The winch 131 is mounted on a platform 135 which has mounting bracket 137 attached at one end. The mounting bracket 137 and the pole 3 have cooperating locking means whereby the platform can be detachably mounted on the outside of the pole 3. These cooperating locking means can comprise keyhole slots 139 in the wall 140 of the pole and mating bolts 141 on the bracket 137.

Figure 6:
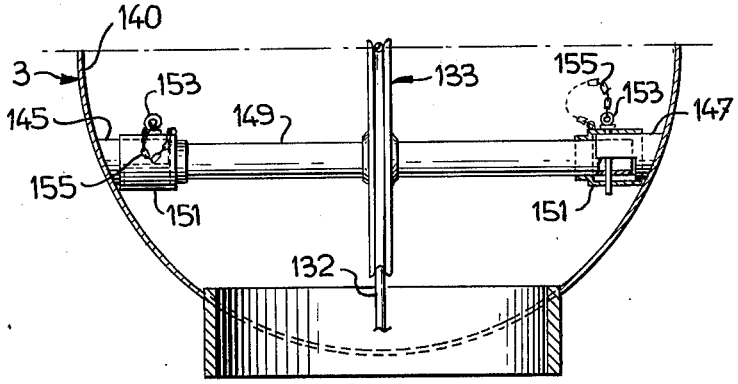
FIG. 6 is a detail partial plan view of the bottom portion of the pole.

The platform 135 is mounted just beneath an opening 143 in the pole 3 which opening is normally closed by a removable door (not shown). The switch box 103, case 87 and chain 89 are accessible from opening 143. Mounted within pole 3 adjacent opening 143, and on the inner surface of wall 140 of pole 3, are a pair of opposed sockets 145, 147 as shown in FIG. 6.

A shaft 149 is adapted to be detachably mounted within and between the sockets 145, 147. Sleeves 151 are fixedly provided on each end of shaft 149 for sliding over sockets 145, 147. Sleeves 151 each carry a pin 153 attached by a chain 155. The sockets, sleeves and shaft ends each have diametrically opposed holes, which, when aligned at each end, allow the pins 153 to slide through the aligned holes to lock the shaft 149 in place in the sockets. The shaft 149 and sleeves 151 are sized so that one end of the shaft can be slid fully into one socket 145 so that the other end of the shaft can be aligned with the other socket 147. The shaft 149 is then slid a short distance in the opposite direction to locate it within both sockets 145, 147 as shown in FIG. 6. The shaft 149 carries rotatable pulley 133 midway between its ends. Preferably the pulley 133 is sized so that the vertical central axis of pole 3 is tangent to the pulley.

In operation, when it is desired to lower structure 13 to service lights 19, the cover is removed from opening 143 and pulley 133 is mounted within pole 3 and winch 131 outside the pole. Cable 132 is attached, from winch 131 and about pulley 133, to the bottom of case 87 while chain 89 is removed. Plug 107 is removed from connector 111 and plugged instead into a connector on winch motor 163 as shown by dotted line 105'.

A switch 165 operates motor 163 in either direction. Motor 163 is first operated to slightly raise structure 13. To this end, cable 132 is wound up on the winch, via pulley 133, and case 87 is lowered pulling down cables 73 over pulley 81, 83, and lifting up ring 15. This has the effect of lifting rods 57 up out of notches 37, and, guided by edge 45, out of slots 47. The ring 15 rotates slightly as it moves out of slots 47, since each opening 79 in bottom wall 27 from where a cable 73 emerges is circumferentially offset a slight distance from end wall 33 of an associated member 25 as shown in FIG. 9.

The ring 15, and more particularly its fixed suspension means 23 is now clear of the fixed suspension means 21 on the support 9. Switch 165 is then operated to reverse motor 163 and lower ring 15 down the pole to a position adjacent opening 143. The rods 57 on the bottom of the ring 15 intercept downwardly sloping rods 53 on the members 25 hanging from support 9 as ring 15 is lowered. However the rods 57 slide off the ends of rods 53, rotating ring 15 slightly as this happens. When the ring 15 is lowered to a position adjacent opening 143, as shown in FIG. 5, where the lights 19 can be serviced, the winch 131 is stopped. To check out the lights 19 during servicing, electric cable 105 can be removed from winch motor 163 and plugged into ring 15 at connection 167 as shown by dotted lins 105''. Connection 167 connects to leads 119 within ring 15.

After the lights have been serviced, cable 105 can again be connected to winch 131 and the winch operated, by switch 165, to raise ring 15 and lower case 87. As the ring 15 approaches support means 9, rods 57 on ring 15, intercept rods 53 on support means 9. The rods 57 are guided up cam edge 31, vertical edge 41 and guide edge notch 37. During this movement, ring 15 rotates to the right (when viewing FIG. 9) then to the left into notch 37. Once the rods 57 are in notches 37, the ring 15 is locked in a suspended position just beneath support means 9. The winch 131 could be reversed slightly just to lower ring 15 to ensure that rods 57 on the ring 15 rest in the bottom of the notches 37. This reversal of winch 31 could occur when it is observed that the ring 15 begins to rotate back to the left. Cable 105 is then disconnected from winch 131 and reconnected to connector 111 in case 87 to provide power to the lights in their raised position. The chain 89 is connected to case 87 after cable 132 is removed. Winch 131, including platform 135 is then removed, as is pulley 133 on shaft 149, and opening 143 is closed.

Figure 10:
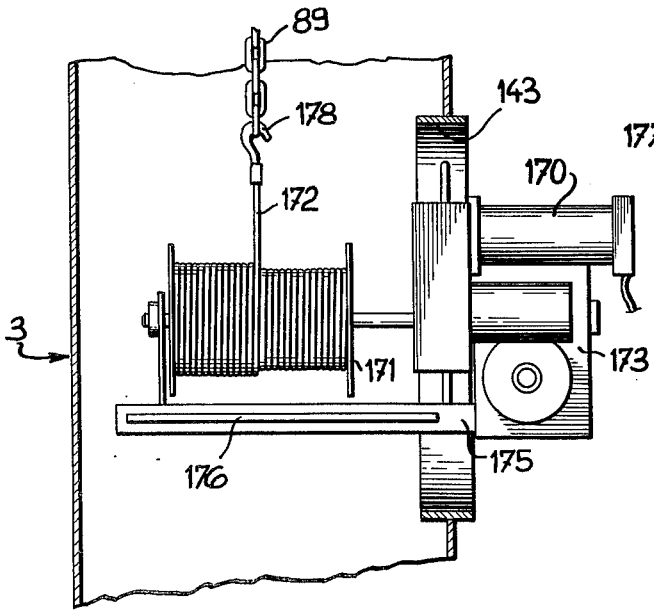
FIG. 10 is a sectional view of the bottom portion of the lighting structure, in which another type of operating means is mounted.

According to another embodiment, the lowering means comprise a motor 170, a train of gear-wheels 173, and a winch 171 having a cable 172, as shown in FIG. 10. These motor 170, train of gear-wheels 173 and 171 are fixed on a support 175 having two lateral rails 176, whereby that support 175 can be detachably mounted on the pole 3.

Figure 11:
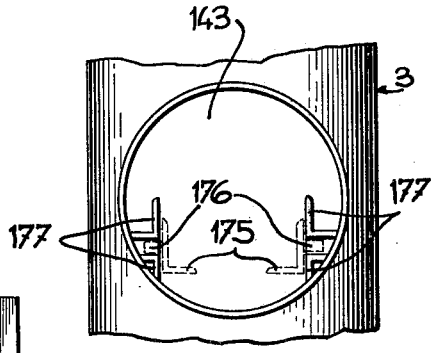
FIG. 11 is an elevation view of the opening at the bottom portion of lighting structure, when the operating means showed in FIG. 10 are used.

The support 175 is mounted through the opening 143 in the pole 3, which opening is normally closed by a removable door (not shown). Mounted within pole 3 adjacent to opening 143, and on the inner surface of wall of pole 3, are a pair of opposed elongated brackets 177 horizontally disposed as shown in FIG. 11, in which can slide the rails 176.

In operation, the support 175 on which are fixed the lowering means is mounted within the pole 3 and the cable 172 is attached by a hook 178 from the winch 171 to the bottom of chain 89. The remaining steps of operation are identical with those above described.

Because the light towers 1 are usually so high it may be difficult to tell when the rods 57 are in notches 37 so that raising of ring 15 can be terminated. To overcome this problem visual indicators 201 can be provided on the support means 9 to indicate when the ring 15 has been raised high enough to have rods 57 sit in notches 37. The visual indicators 201 can comprise one or more substantially circular discs 203, as shown in FIG. 3, mounted along a portion of its edge on a shaft 205. Shaft 205 is fixed to side wall 35 of member 25 and extends substantially horizontally. The disc 203 is mounted with a spring (not shown) on shaft 205 which spring normally biases the disc 203 to a vertical position adjacent side wall 35 as shown in FIGS. 7 and 9. A tab 207 on disc 203 extends through a slot 209 in wall 35 to lie in the path of rod 57 as it moves in slot 49. The tab 207 normally lies just above vertical guide edge 41. The disc 203 has one surface with a vivid visual appearance. For example, the one surface can be painted red.

In operation, as the ring 15 is raised, and rod 57 is guided in slot 49, the rod 57 will intercept tab 207 as it leaves guide edge 41 to swing against guide edge 43, pivoting the tab 207 up about shaft 205 and pivoting disc 203 down to a horizontal position with the red surfacing facing down. This flash of red indicates that the red 57 has moved into notch 37 to lock the ring in a raised position by the spring after rod 57 passes tab 207. While one form of visual indicator has been described, other forms can be used as well.

I claim:

1. A lighting structure comprising:
   a. a pole;
   b. a support means carried by the upper end of the pole;
   c. a light-carrying structure encircling the pole;
   d. a first fixed suspension means carried by the support means;
   e. a second fixed suspension means carried by the light-carrying structure whereby the first and second fixed suspension means are interengageable to detachably suspend the light-carrying structure from the support means; and
   f. cable means extending from the support means to the light-carrying structure for raising and lower the light-carrying structure on the pole whereby, prior to engagement of the first and second fixed suspension means, the cable means is circumferentially offset with respect to the first suspension means in order to provide a slight rotation of the light-carrying structure about the pole during the engagement and disengagement of the first and second suspension means with each other.

2. The lighting structure of claim 1 wherein:
   a. the first fixed suspension means includes a plurality of first members circumferentially spaced around the pole and depending vertically downwardly from the support means; and
   b. the second fixed suspension means includes a plurality of second members projecting from the light structure from interengagement with the first members.

3. The lighting structure of claim 2 wherein each first member includes a notch and means for guiding its corresponding second member up and into the notch as the light-carrying structure is raised into interengagement of the first and second suspension means.

4. The lighting structure of claim 3 wherein each first member includes means for guiding its corresponding second member up and out of the notch when the light-carrying structure is being disengaged from the support means.

5. The lighting structure of claim 3 further including means carried by each of the first members for providing visual indication that the second members are engaged within their corresponding notches in the first members.

6. The lighting structure of claim 2 wherein:

a. the first fixed suspension means includes at least three first members;

b. the second fixed suspension means includes at least three second members;

c. the cable means includes one support line associated with each pair of interengageable first and second members; wherein each support line extends from the support means to the light-carrying structure;

d. each support line is vertically aligned with its associated second member; and e. each support line is circumferentially offset with respect to its associated first member.

7. The lighting structure of claim 6 wherein the support lines extend from the support means down within the pole to the bottom portion thereof and include detachable means carried by the pole for actuating the lines to raise and lower the light-carrying structure.

8. The lighting structure of claim 7 wherein the detachable means includes a winch and a pulley assembly whereby the winch includes an attachment cable that passes into the pole and over the pulley for attachment to the support lines.

9. The lighting structure of claim 8 further including a motor and train of gear wheels for operating the winch.

10. The lighting structure of claim 9 further including an electrical supply cable at the bottom of the pole and means for selectively connecting the cable to the light-carrying structure in its uppermost position of the pole and to the motor when the light-carrying structure is in its lower-most position on the pole.

* * * * *